United States Patent [19]

Dempsey et al.

[11] 3,998,457

[45] Dec. 21, 1976

[54] TENNIS RACKET

[75] Inventors: Douglas E. Dempsey, Palatine, Ill.; Gerald F. Herndon, West Minster, Colo.

[73] Assignee: Pepsico, Inc., Purchase, N.Y.

[22] Filed: Dec. 20, 1974

[21] Appl. No.: 534,755

[52] U.S. Cl. ..... 273/73 C; 273/73 D; 273/73 F

[51] Int. Cl.[2] ..... A63B 49/10

[58] Field of Search ..... 273/67 R, 67 B, 73 R, 273/73 C, 73 D, 76, 96 D, DIG. 1–DIG. 12, DIG. 16, 82 R, 82 A, 82 B, 58 B, 85 R, 85 A–85 F, 73 F, 73 H, 73 J; 272/85; 46/25, 221, 222, 155, 44; 52/282, 615, 620, 593, 595, 730, 731

[56] References Cited

UNITED STATES PATENTS

| | | | |
|---|---|---|---|
| 1,587,918 | 6/1926 | Morrison | 273/73 C X |
| 1,587,919 | 6/1926 | Morrison | 273/73 H |
| 2,678,158 | 5/1954 | Arant | 273/67 R X |
| 3,102,362 | 9/1963 | Neal | 273/58 B X |
| 3,169,766 | 2/1965 | Ernst | 273/82 R |
| 3,234,683 | 2/1966 | Christiansen | 46/221 X |
| 3,240,495 | 3/1966 | Ek | 273/85 F |
| 3,261,607 | 7/1966 | Horowitz et al. | 273/67 R X |
| 3,438,164 | 4/1969 | Duepree | 52/615 X |
| 3,611,621 | 10/1971 | Folson | 46/25 |
| 3,698,150 | 10/1972 | Anderson | 52/731 |
| 3,810,620 | 5/1974 | Decker et al. | 273/73 H |
| 3,840,230 | 10/1974 | Schaefer | 273/73 F |
| 3,847,395 | 11/1974 | Santilli | 273/67 R X |
| 3,901,507 | 8/1975 | Ormieres et al. | 273/73 C |

FOREIGN PATENTS OR APPLICATIONS

| | | | |
|---|---|---|---|
| 208,945 | 1/1957 | Australia | 273/73 R |
| 1,201,649 | 8/1970 | United Kingdom | 273/73 D |
| 132,698 | 9/1919 | United Kingdom | 273/73 C |
| 566,130 | 12/1944 | United Kingdom | 273/73 D |

*Primary Examiner*—Richard J. Apley
*Attorney, Agent, or Firm*—Hill, Gross, Simpson, Van Santen, Steadman, Chiara & Simpson

[57] ABSTRACT

This invention is concerned with a tennis racket frame which comprises a pair of channel-shaped members in interengaging relationship, the channel-shaped members forming the faces of the head portion of the racket frame, and the sidewalls of each of the members having apertures therein in alignment to provide string holes therein. The racket frame is preferably composed of a synthetic resinous material which may be integrally reinforced with high modulus reinforcing fibers, or reinforced by attached facings of high strength, high modulus materials.

13 Claims, 6 Drawing Figures

Fig. 1
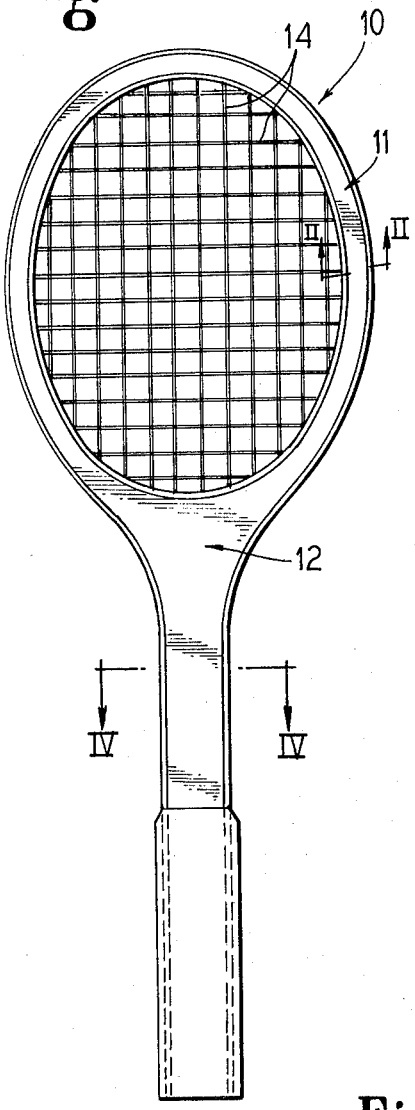
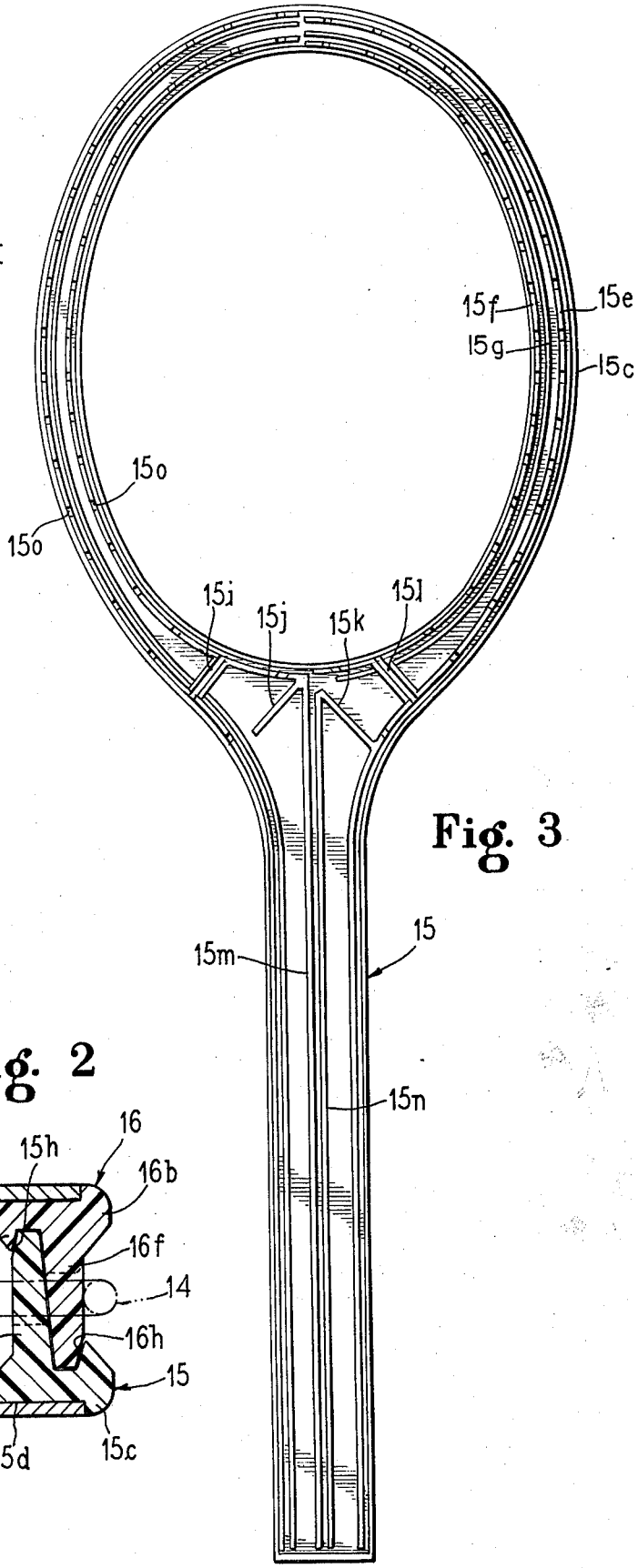
Fig. 3
Fig. 2
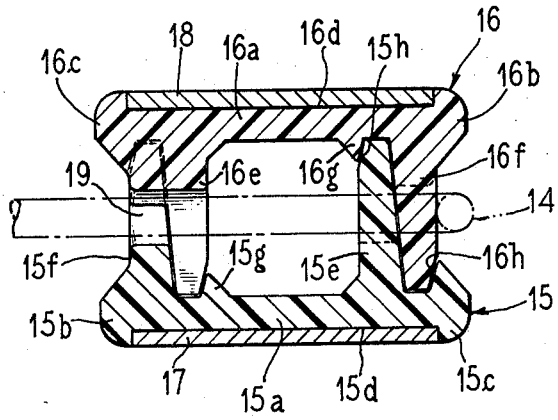

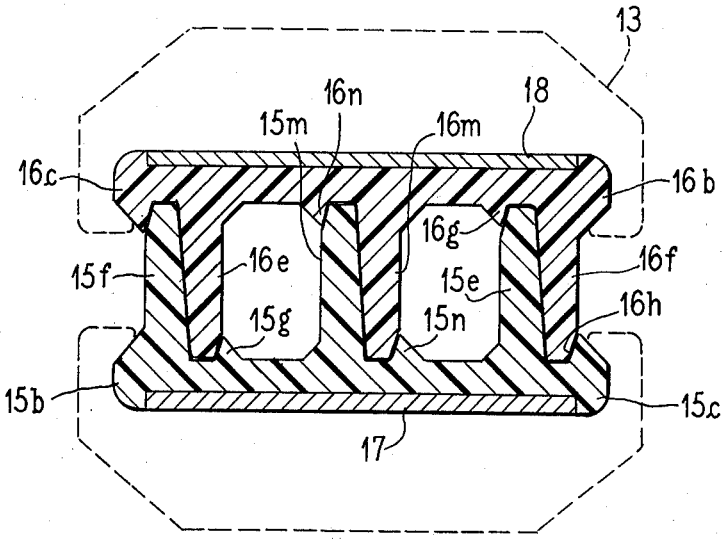
Fig. 4
Fig. 5
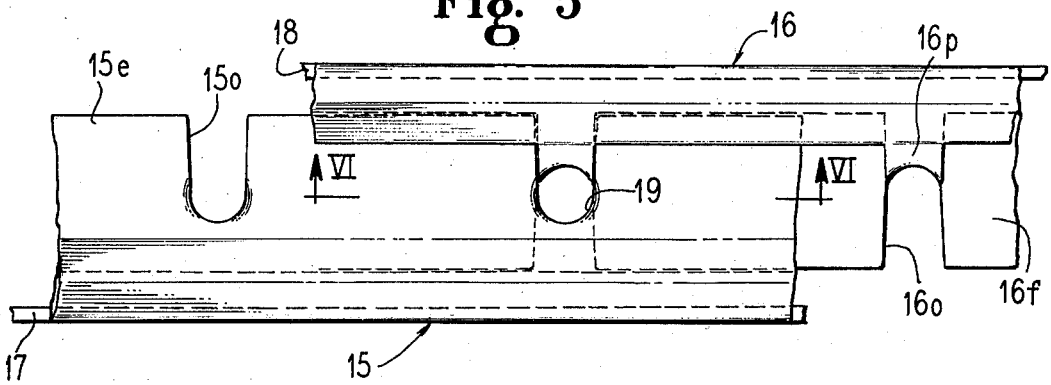
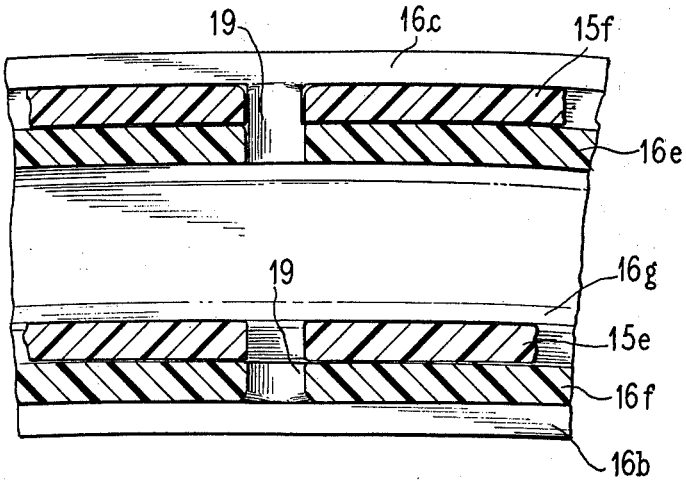
Fig. 6

TENNIS RACKET

BACKGROUND OF THE INVENTION

1. Field of the Invention

This invention is in the field of tennis rackets made up of essentially two channel-shaped members which have interengaging portions within their geometrics so that they can be received in tight interengaging relationship.

2. Description of the Prior Art

All are familiar with the conventional tennis rackets which for years have been made of wood and provided with gut or nylon strings. The playing characteristics of such wood rackets, however, unavoidably vary because of differences in the character of the wood, humidity and age. Such changes may tend to cause the head of the racket to warp due to variations in string tension.

The prior art is also replete with suggestions relating to steel and aluminum tennis rackets which do not have some of the noted disadvantages of the wood rackets but they are nevertheless difficult to fabricate and quite expensive.

The prior art also contains numerous disclosures, some of them quite incidental, dealing with the use of synthetic resins as materials for tennis racket manufacture, either alone or in combination with metal. The following discussion refers to some of such prior art disclosures but is meant to be illustrative only and is certainly not exhaustive.

In the late 1920's Robinson in his U.S. Pat. No. 1,636,867 disclosed a tennis racket which included a truss-type structure which could be utilized alone or embedded in a suitable material such as a "Bakelite" thermosetting resin. Panker U.S. Pat. No. 1,954,327 which issued in 1934 referred to a method of making tennis rackets by embedding a previously tightly stretched network in a frame consisting of a material which during embedding was rendered plastic and which hardened after being shaped to the desired shape to secure the strings firmly in position.

Hatton U.S. Pat. No. 2,274,788 issued in 1942 described a composite tennis racket in which a central metal tube was encased in a suitable plastic material such as a cellulose base material or a thermosetting resin.

Robinson U.S. Pat. No. 2,593,714 issued in 1952, describes in connection with FIG. 170 a method for manufacturing a tennnis racket in which plastic tubes are inserted into a prepared mold, utilizing tapered insert pins inserted between the opposed plastic tubes to form the stringing holes.

In more recent times, Eshbaugh in U.S. Pat. No. 3,483,055 which issued in 1969 described a method of producing tennis racket frames from flexible winding materials which involved the winding of such winding materials about a suitable form and then heat curing the materials to a rigid condition while under pressure.

Howe U.S. Pat. No. 3,690,658 described a tennis racket construction having a central dampening core sandwiched between skins of high strength material which served as the racket faces. The bow portion of the racket had at least one web having higher strength characteristics than the core, and extending normal to the skins, Layers of elastomeric material were utilized between the skins and the core to assist in laminating the core, skins and web into a unitary structure.

Erwin et al. U.S. Pat. No. 3,755,037 which issued in 1973 described a racket composed of a head portion and a handle portion integrally formed by a tubular member composed of helically wound fibers of high tensile strength embedded in a hardened binder having a preformed reinforcing member defining the base of the oval head portion and bounded on opposite sides to the tubular member, the handle portion being defined in part by generally parallel extending portions of the tubular member surrounded by a grip. The racket was produced by helically winding high strength fibers around the core, removing the core and finally hardening the binder.

Regardless of the method employed for making tennis rackets from synthetic resinous materials, the punching and drilling of string holes in volume production is quite an expensive procedure because of the costs of the tooling and the drilling time required. To our knowledge, no one had successfully molded in holes into a synthetic resin frame because of the complexity required in the mold.

The present invention overcomes the difficulty of the prior art and provides a tennis racket frame utilizing readily moldable parts having generally uniform wall thicknesses, the geometry of the parts being such that they can be identical in cross-section and by inverting one part with respect to the other, the various ribs and walls are made to engage with each other into firm integrated relationship.

SUMMARY OF THE INVENTION

The present invention provides a tennis racket frame comprising a pair of channel-shaped members, the two channel-shaped members preferably having identical cross-sectional configurations so that all of the members can be made from a single mold. Each channel-shaped member preferably has a marginal rib, a first upstanding wall portion spaced from the marginal rib by a first groove, a second upstanding wall portion adjacent the other marginal edge of the member, and a second groove inwardly of the second wall portion.

In a particularly preferred form of the present invention, we provide a tennis racket frame in which each of the channel-shaped members has a flat base portion, a marginal rib of equal or greater thickness than the base portion at each marginal edge thereof, the marginal ribs having depending portions defining a flat recessed portion at the underside of the base portion, a first wall extending perpendicular to the base portion and spaced from one of said marginal ribs by a distance slightly less than the width of the first wall, a second wall extending from the base portion in parallel spaced relation to the first wall, the second wall having a width and height dimension the same as those of the first wall, and means extending from the base portion to define a groove inwardly of the second wall and having a width slightly less than that of one of the walls. The channel-shaped members are interengaged with one channel member being in inverted relation with respect to the other, one wall of one channel member being received between the marginal rib and a wall of the other channel member, and the other wall of the channel member being bottomed in the aforementioned groove. Each of the walls of the channel members may have a tapered end portion to facilitate wedge locking engagement between the two channel members. Each of the channel-shaped members is provided with slots therein which are arranged to be aligned with slots in the other channel member so that the slots when in registry define string holes for the frame.

The rackets of the present invention may also be provided with facing strips on both faces thereof for purposes of increasing the stiffness and strength.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a plan view of a tennis racket produced according to the present invention;

FIG. 2 is an enlarged cross-sectional view taken substantially along the line II—II of FIG. 1;

FIG. 3 is a plan view of one of the two channel members before the two members are assembled into interengaging relationship to form the finished racket;

FIG. 4 is an enlarged cross-sectional view of the handle portion taken substantially along the line IV—IV of FIG. 1;

FIG. 5 is an enlarged elevational view illustrating the manner in which the slots in the two interengaging channel members cooperate to define stringing holes; and FIG. 6 is an enlarged cross-sectional view taken substantially along the line VI—VI of FIG. 5.

DESCRIPTION OF THE PREFERRED EMBODIMENTS

In FIG. 1, reference numeral 10 indicates generally a tennis racket produced according to the present invention and including a head portion 11, a throat portion 12 and a handle portion 13. The head of the racket is provided with the usual strings 14 extending along and across the oval-shaped head portion 11.

Turning now to FIGS. 2 and 3 it will be seen that the tennis racket of the present invention involves the interengagement of two channel-shaped members generally identified at reference numerals 15 and 16, respectively. For convenience, since the two channel members 15 and 16 are identical in cross-sectional configuration, corresponding portions of these two channel members will be given the same subscripts. Thus, the channel-shaped member 15 has a flat portion **15*a* while the channel-shaped member 16 has a similar flat base portion 16*a*. The channel-shaped member 15 is provided with a marginal rib 15*b* at one marginal edge thereof and a second marginal rib 15*c* along its other marginal edge. The ribs 15*b* and 15*c* have a thickness equal to or greater than the thickness of the flat base portion 15*a*. Similarly, the channel member 16 has corresponding marginal rib portions 16*b* and 16*c*. The marginal rib portions 15*b* and 15*c* (as well as rib portions 16*b* and 16*c*) are formed with flat recessed portions 15*d* and 16*d*, respectively, for receiving flat facing strips 17 and 18**. These facing strips may be strips of synthetic resin containing steel, fiberglas, graphite, aluminum, titanium, boron, or other high modulus fibers, or they may be strips of high strength, high modulus metals which add stiffness and strength to the frame assembly.

The channel-shaped members themselves may be made of a reinforced plastic material such as a nylon which is reinforced with short fibers of glass, steel, aluminum or other stiff material. While the use of facing strips 17 and 18 will be desirable in most instances, they may not be required if the body of the channel members is composed of an exceptionally strong composite material such as one containing "Kevlar 49" which is the Du Pont Company's trademark for its lightweight, high strength, high modulus organic reinforcing fibers contained in an epoxy or polyester matrix.

The channel-shaped member 15 includes a first wall **15*e* which is spaced from the marginal rib 15*c* by a distance slightly less than the width of the wall 15*e*. Similarly, a wall 16*e* extends perpendicular to the flat base portion 16*a* of the channel member 16. A second wall 15*f* extends perpendicular to the base portion 15*a* in generally parallel spaced relation to the wall 15*e*, the second wall 15*f* having a width and height dimension the same as those of the first wall 15*e*. The corresponding wall portion on channel member 16 has been identified at reference numeral 16*f*. An angular rib 15*g* is provided on the base portion 15*a* in spaced relation to the wall portion 15*f* to define a groove therein inwardly of the wall 15*f*, the groove having a width slightly less than the width of the wall 15*e* or 15*f*. The channel member 16 is provided with a corresponding rib 16*g*, as shown in FIG. 2. The walls 15*e* and 15*f* as well as walls 16*e* and 16*f* are provided with tapered end portions such as those indicated at 15*h* and 16*h*, respectively, to facilitate a wedge locking engagement between the two sections when they are mated in the position shown in FIG. 2 of the drawings. In other words, the wall 16*f* is fitted in wedged engagement in the groove which exists between the wall 15*e* and the rib 15*c* and the wall 15*e* has a tapered end portion 15*h* which facilitates wedge locking engagement in the groove provided between the rib 16*g* and the wall 16*f*. The same is true, of course, in the opposite side where the wall 16*e* is received in wedged engagement between the rib 15*g* and the rib 15*b* and the wall 15*f* is likewise received in the groove provided between the web 16*c* and the wall 16*e***.

Turning next to FIG. 3, it will be seen that the walls **15*e* and 15*f* cooperate to define the oval string-receiving head portion of the racket and their extremities define the handle portion of the racket. At the throat portion of the racket, there may be provided additional brace members 15*i*, 15*j*, 15*k* and 15*l* which cooperate with corresponding base members on the channel-shaped member 16** to provide additional rigidity in the throat section.

The channel-shaped member 15 may also include a centrally extending wall **15*m* in that portion of the channel-shaped member which extends from the throat of the racket through the handle portion, as best illustrated in FIG. 4. The wall 15*m* is received in a groove provided by an angular rib 16*n* which is spaced from the corresponding centrally disposed wall 16*m* of the channel section 16. The end portion of the wall 16*m* is, in turn, received in the groove provided between the wall 15*m* and an angular rib 15*n* formed in the base portion of the channel member 15**.

The manner in which the string holes are provided is best illustrated in FIGS. 5 and 6 of the drawings. As there illustrated, the wall member **15*e* (as well as the wall member 16*e*) is provided with a series of spaced slots 15*o* which are arranged to be aligned with correspondingly shaped slots 16*o* provided in the wall 16*f* and thereby defining a plurality of spaced string apertures 19** as best seen in FIGS. 5 and 6. As best seen in FIG. 6, the apertures 19 which extend between the abutting walls 15*b* and 16*e* are aligned with the apertures 19 which extend between the abutting walls 15*e* and 16*f*. It should also be noted that the walls in the vicinity of the slots 15*o* and 16*o* can be rounded off to give a relatively wide radius (a 1/16 inch or so) to avoid any sharp edges at the string hole areas. The extremity of the slot 16*o*, identified at 16*p*, may be provided with a double wall thickness to create a flush face at the resulting hole when the two sections are mated.

The channel members 15 and 16 are assembled as shown in FIGS. 2 and 4 and may be secured together with a suitable adhesive or otherwise secured together. Then, the handle portion 13 may be provided in the usual manner, as by applying a pair of pallets to the frame structure and winding a layer of leather over the assembled pallets.

The tennis racket assembly of the present invention has unique advantages as compared with other tennis racket assemblies composed of plastic materials. For one, the two channel sections are readily moldable in a single mold. The string holes are achieved without drilling as a natural result of the geometry employed. Furthermore, the cross-section of the channels can be shaped to create string protection channels. The mating sections are also such that it is virtually impossible to detect that the frame is made of two sections.

It should be evident that various modifications can be made to the described embodiments without departing from the scope of the present invention.

We claim as our invention:

1. A tennis racket frame comprising a pair of channel-shaped members of substantially identical configuration having a looped head portion defining a stringing plane, a throat portion and a rectangular shank and handle portion, each of said channel-shaped members having a base portion parallel to the stringing plane of said racket, a marginal rib at least as thick as said base portion and constituting each marginal edge thereof, a first wall extending perpendicular to said base portion and spaced from one of said marginal ribs by a distance slightly less than the width of said first wall thereby defining a first groove therebetween, a second wall extending from said base portion in parallel spaced relation to said first wall, said second wall having width and height dimensions the same as those of said first wall, and angular rib means extending from said base portion to define a second groove inwardly of said second wall and having a width slightly less than that of one of said walls.

2. The racket frame of claim 1 in which said channel-shaped members are interengaged with one channel member being in inverted relation with respect to the other, one wall of said one channel member being received in said first groove between said marginal rib and a wall of the other channel member, and the other wall of said one channel member being bottomed in said second groove.

3. The racket frame of claim 8 in which each of the walls of the channel members has a tapered end portion to facilitate wedge locking engagement within the grooves defined by each of said angular rib means.

4. The racket frame of claim 1 in which said channel members are composed of a synthetic resin.

5. The racket frame of claim 4 in which the channel-shaped members are composed of a fiber reinforced synthetic resin.

6. The tennis racket frame of claim 1 in which the exterior faces of said bases having a flat recessed portion running therealong, and a facing strip secured within each of said recesses.

7. The tennis racket frame of claim 2 in which the walls of the head portion of said channel-shaped members have slots therein in registry with slots in the other channel members when said channel-shaped members are interengaged to provide string holes for said frame, said string holes being arranged to receive strings in the stringing plane in mutually perpendicular directions.

8. A tennis racket frame comprising a pair of interengaged channel-shaped members, each of said channel-shaped members being configured to provide a looped head portion, a handle portion and a neck portion connecting said head and handle portions, each of said channel-shaped members having a cross-sectional configuration which includes a flat base, at least two walls extending in parallel spaced relation along its length perpendicular to said base, said walls being spaced slightly inwardly from the marginal edges of said channel-shaped member and each channel-shaped member having a groove adjacent each wall and extending in parallel relation thereto, said channel-shaped members being interengaged so that the walls in one member are bottomed in the grooves of the other member and vice versa.

9. The racket frame of claim 8 in which said walls in said looped head portion are provided with elongated spaced round bottom slots with their major axes perpendicular to said base such that upon interengagement of said channel-shaped members, the slots in one channel-shaped member resister with the slots of the other channel-shaped member to form circular stringing holes for the racket frame.

10. The racket frame of claim 8 in which the exterior faces of said bases are provided with flat recessed portions for receiving a facing material therein.

11. The racket frame of claim 8 in which said channel-shaped members are composed of a synthetic resin.

12. The racket frame of claim 11 in which said channel-shaped members are composed of a fiber reinforced nylon.

13. A tennis racket frame comprising a pair of identical channel-shaped members each having spaced walls and grooves therealong, said channel-shaped members being interengaged in inverted relationship with each other so that walls of one member are received in grooves of the other, said walls having spaced elongated slots therein in spaced relation, the slots in said walls cooperating when said channel members are in said inverted relationship to provide spaced substantially round stringing holes by the overlapping of said elongated slots, said holes being on centerlines extending transversely to the planes of the walls.

* * * * *